US008128086B2

(12) United States Patent
Obuchi

(10) Patent No.: US 8,128,086 B2
(45) Date of Patent: Mar. 6, 2012

(54) SHEET STACKING APPARATUS AND IMAGE FORMING APPARATUS

(75) Inventor: Yusuke Obuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 11/849,964

(22) Filed: Sep. 4, 2007

(65) Prior Publication Data

US 2008/0054551 A1 Mar. 6, 2008

(30) Foreign Application Priority Data

Sep. 6, 2006 (JP) ..... 2006-242077
Aug. 21, 2007 (JP) ..... 2007-214887

(51) Int. Cl.
*B65H 31/26* (2006.01)
*B65H 31/36* (2006.01)

(52) U.S. Cl. ..... 271/221; 271/220

(58) Field of Classification Search ..... 271/224, 271/221, 220, 3.02, 222; 270/30.07
See application file for complete search history.

(56) References Cited

U.S. PATENT DOCUMENTS

| | | | | |
|---|---|---|---|---|
| 4,380,332 | A * | 4/1983 | Davis | 271/224 |
| 4,867,436 | A * | 9/1989 | Hanada et al. | 271/221 |
| 5,005,821 | A * | 4/1991 | Burger | 271/198 |
| 5,054,764 | A * | 10/1991 | Phillips et al. | 271/189 |
| 6,302,606 | B1 * | 10/2001 | Hayakawa et al. | 400/625 |
| 6,412,774 | B1 * | 7/2002 | Saito et al. | 271/220 |
| 6,652,938 | B1 * | 11/2003 | Nishikawa et al. | 428/35.9 |
| 6,783,125 | B2 * | 8/2004 | Shoji et al. | 270/58.12 |
| 7,007,946 | B1 * | 3/2006 | Dobrindt et al. | 271/189 |
| 7,007,948 | B2 * | 3/2006 | Kamiya et al. | 271/221 |
| 7,527,260 | B2 * | 5/2009 | Moore | 271/176 |
| 2002/0113362 | A1 * | 8/2002 | Saito et al. | 271/207 |
| 2003/0218298 | A1 * | 11/2003 | Yamakawa et al. | 271/220 |
| 2004/0183249 | A1 * | 9/2004 | Sato | 271/220 |
| 2007/0029724 | A1 * | 2/2007 | Sato | 271/220 |
| 2007/0069453 | A1 * | 3/2007 | Thomas et al. | 271/207 |

FOREIGN PATENT DOCUMENTS

| | | |
|---|---|---|
| JP | 04-135548 | 12/1992 |
| JP | 06-074108 | 9/1994 |
| JP | 06-044937 | 11/1994 |
| JP | 07-137921 | 5/1995 |
| JP | 11-228009 | 8/1999 |
| JP | 2006-124052 | 5/2006 |
| JP | 2006-27865 | 8/2006 |
| JP | 2007-518646 | 7/2007 |
| WO | 2005/073116 | 8/2005 |

* cited by examiner

*Primary Examiner* — Kaitlin Joerger
*Assistant Examiner* — Patrick Cicchino
(74) *Attorney, Agent, or Firm* — Canon USA Inc. IP Division

(57) ABSTRACT

A sheet discharged from a sheet discharging portion arranged at a distance from a sheet stacking portion, to a stacking portion, is conveyed along the sheet stacking portion while the sheet edge on an upstream side in a sheet discharging direction is held. A shifting unit arranged downstream of the sheet stacking portion in the sheet discharging direction shifts the discharged sheet from the sheet discharging portion toward the downstream side in the sheet discharging direction while a pressing member presses the sheet to the sheet stacking portion.

9 Claims, 10 Drawing Sheets

SHEET STACKING APPARATUS AND IMAGE FORMING APPARATUS

BACKGROUND OF THE INVENTION

1. Field of the Invention

The present invention relates to a sheet stacking apparatus and an image forming apparatus.

2. Description of the Related Art

In recent years, thanks to technological advances, an image forming apparatus has become capable of forming images at high speed. Together with the increase in image forming speed, sheet discharging speed from the image forming apparatus has also increased. As a result, demand for a high-volume sheet stacking apparatus capable of precisely aligning the sheets is increasing.

Japanese Patent Application Laid-Open No. 2006-124052, for example, discusses a sheet stacking apparatus which includes a pressing member that presses a sheet to a sheet stacking tray so that the sheet can be more speedily discharged onto the sheet stacking tray.

FIG. 10 illustrates a configuration of a conventional sheet stacking apparatus 100 which enables high-volume output. The sheet stacking apparatus is attached to a conveying belt 508 that rotates clockwise and includes a gripper 503. The gripper 503 rotates together with the conveying belt 508 to convey a sheet while holding a leading edge of the sheet. Further, the sheet stacking apparatus includes a leading edge pressing member 506 and a trailing edge pressing member 507 configured to press down a leading edge and a trailing edge of a sheet.

In the sheet stacking apparatus having such a configuration, a sheet discharged from an image forming apparatus (not shown) is received by an inlet roller 501 and then a leading edge of the sheet is passed on to the gripper 503 by a conveyance roller 502. Then, the conveying belt 508 rotates, and the gripper 503 moves together with the conveying belt 508 while holding the leading edge of the sheet. In this way, the sheet is conveyed along the upper portion of a sheet stacking tray 505.

When the leading edge of the sheet abuts against a leading edge stopper 504, the gripper 503 releases the sheet so that the sheet is discharged onto the sheet stacking tray 505. In this manner, a predetermined number of sheets are stacked. Every time a sheet is stacked, an alignment member (not shown) performs a jogging process in a direction perpendicular to the sheet conveying direction (hereinafter referred to as width direction) so that an alignment of the sheets is improved.

When sheets are stacked at high speed, possibility of a sheet jam is increased, which occurs when a sheet interferes with a trailing edge of a preceding sheet stacked on the sheet stacking portion 505. Therefore, during sheet stacking, the leading edge pressing member 506 and the trailing edge pressing member 507 press down a leading edge and a trailing edge of a sheet against the sheet stacking tray so that the sheet reaches the sheet stacking tray 505 more quickly.

In other words, when sheets are stacked at high speed, the leading edge pressing member 506 and the trailing edge pressing member 507 press a leading edge and a trailing edge of a sheet against the sheet stacking tray 505 at the time the sheet is discharged to the sheet stacking tray 505 so that the sheet is out of the way of the next sheet.

However, in such a conventional sheet stacking apparatus, when a sheet is pressed to the sheet stacking tray by the leading edge pressing member 506 and the trailing edge pressing member 507, a path on which the sheet takes from a release step to landing is not fixed. Therefore, accuracy of stacking position is considerably poor.

Especially when priority is given to pressing by the trailing edge pressing member 507 to increase stacking speed, the sheet can be pressed in a state that the sheet leans against the stacking wall Y. In this case, not only damage is given to the sheet but also accuracy of stacking deteriorates.

Also, in a case where the leading edge pressing member 506 presses a leading edge portion of a sheet, the leading edge pressing member 506 can be configured to wait at a position 506' and then rotate counterclockwise around a center of rotation X. In this case, a pressing force acts also in the right direction as shown in FIG. 10.

Thus, in a case when a leading edge of a sheet is pressed by the leading edge pressing member 506, not only a force acts on the sheet stacking stray 505 but also acts in the right direction in FIG. 10. Accordingly, the leading edge of the sheet is curled. As a result, stacking accuracy is decreased and an undesired curl will be formed on the sheet.

Consequently, if a sheet discharged onto the sheet stacking tray 505 is simply pressed by the leading edge pressing member 506 and the trailing edge pressing member 507, stable stacking with high accuracy is not achieved.

SUMMARY OF THE INVENTION

The present invention is directed to a sheet stacking apparatus capable of stacking sheets at a high speed with stability and a high degree of accuracy, and an image forming apparatus including such a sheet stacking apparatus.

According to one aspect of the present invention, a sheet stacking apparatus includes a sheet discharging portion configured to discharge a sheet, a sheet stacking portion configured to stack the sheet discharged from the sheet discharging portion, a shifting unit configured to shift a sheet edge to a predetermined position on the sheet stacking portion, and a pressing member configured to press the sheet discharged from the sheet discharging portion to the sheet stacking portion. The sheet is pressed to the sheet stacking portion by the pressing member while the sheet edge is kept at the predetermined position by continuing a shifting operation of the shifting unit.

The sheet shifting unit shifts to maintain an aligned state of the sheet discharged from the discharging portion while the pressing member presses the sheet to the sheet stacking portion so that sheets can be stacked at a high speed with stability and a high degree of accuracy.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
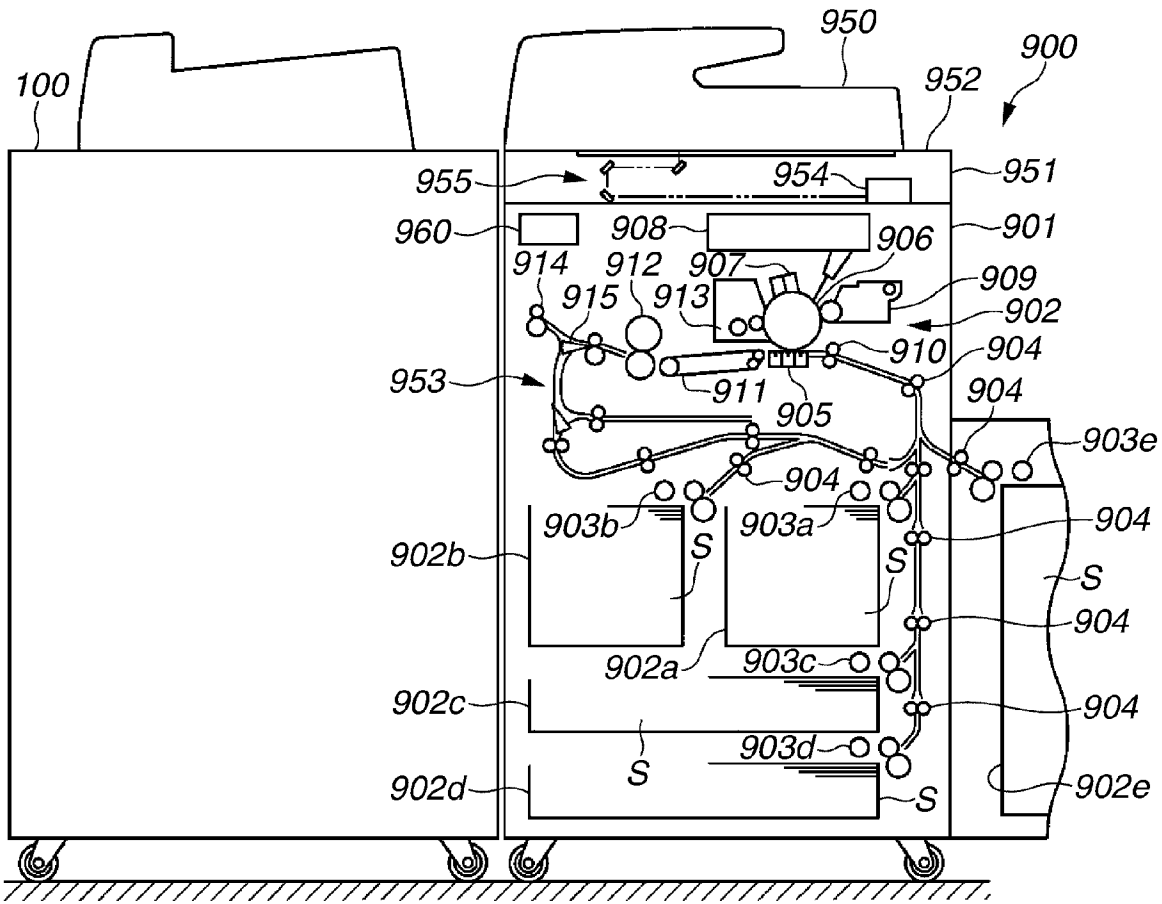
FIG. 1 illustrates a configuration of an image forming apparatus including a sheet stacking apparatus according to an exemplary embodiment of the present invention.

FIG. 1 illustrates a configuration of an image forming apparatus including a sheet stacking apparatus according to an exemplary embodiment of the present invention.

FIG. 1 illustrates an image forming apparatus 900 and an image forming apparatus main body 901. The image forming apparatus main body 901 is provided with an image scanning apparatus 951 having a scanner unit 955 and an image sensor 954, an image forming unit 902 configured to form an image on a sheet, a double-side printing device 953, and a platen glass 952. Further, a document feeding apparatus 950 configured to feed a document to the platen glass 952 is provided on the upper part of the image forming apparatus main body 901.

The image forming unit 902 includes a cylindrical photosensitive drum 906, a charging unit 907, a developer 909, and a cleaning apparatus 913. Also, a fixing apparatus 912 and a discharge roller pair 914 are provided downstream of the image forming unit 902. A stacker 100 (i.e., a sheet stacking apparatus) is connected to the image forming apparatus main body 901. The stacker 100 is configured to stack image-formed sheets discharged from the image forming apparatus main body 901. A control unit 960 mounted on the image forming apparatus main body 901 controls the image forming apparatus main body 901 and the stacker 100.

Next, an image forming operation of the image forming apparatus main body 901 having the above configuration will be described.

When the control unit 960 outputs an image forming signal, the document feeding apparatus 950 places a document on the platen glass 952. Then, the image scanning apparatus 951 scans an image of the document, and the scanned digital data is input to an exposure apparatus 908. The exposure apparatus 908 irradiates the photosensitive drum 906 with a light corresponding to the digital data.

At this time, the surface of the photosensitive drum 906 is evenly charged by the charging unit 907. When laser beams from the exposure apparatus 908 scans the photosensitive drum 906, an electrostatic latent image is formed on the surface of the photosensitive drum 906. The developer 909 develops the electrostatic latent image, and a toner image is formed on the surface of the photosensitive drum 906.

On the other hand, when the control unit 960 outputs a sheet feed signal, a sheet S set on one of cassettes 902*a* through 902*e* is conveyed to a registration roller 910 by corresponding feeding rollers 903*a* through 903*e* and a conveyance roller pair 904.

Next, the sheet S is conveyed to a transfer unit including a charging unit 905 at a timing such that the leading edge of the sheet synchronizes with the toner image on the photosensitive drum 906 owing to the registration roller 910. At the transfer unit, a transfer bias is applied to the sheet S by the charging unit 905, and a toner image on the photosensitive drum 906 is transferred to the sheet.

Subsequently, the sheet S with the transferred toner image is conveyed to the fixing apparatus 912 by a conveying belt 911. The toner image is thermally fixed while the sheet is sandwiched between and conveyed by the heating roller and the pressure roller of the fixing apparatus 912. At this time, undesired matter such as remaining toner which was not transferred to the sheet is scraped off by a blade of the cleaning apparatus 913 from the photosensitive drum 906. As a result, the surface of the photosensitive drum 906 is cleaned and ready for the next image forming process.

The image-fixed sheet is conveyed to the stacker 100 by the discharge roller pair 914 or conveyed to the double-side printing device 953 where the sheet is reversed by a flapper 915 to form an image again.

Figure 2:
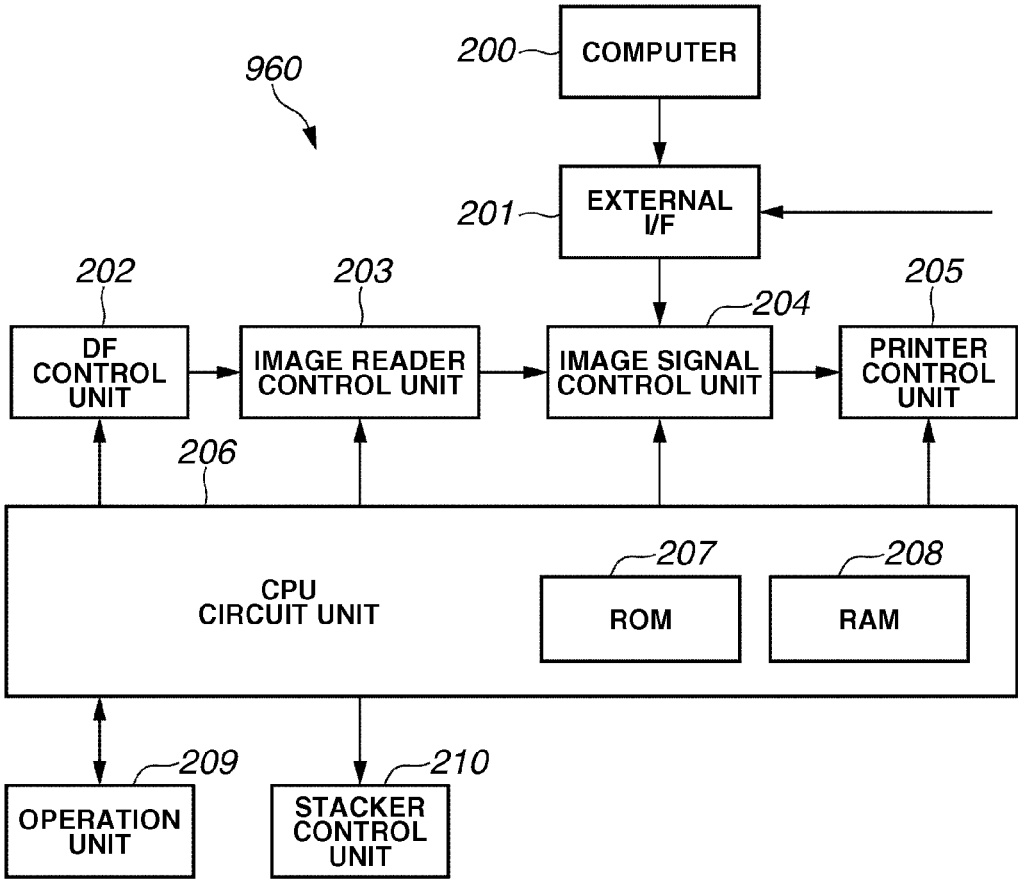
FIG. 2 illustrates a block diagram of a control unit provided in the above-described image forming apparatus.

FIG. 2 is a block diagram illustrating a configuration of the control unit 960. The control unit 960 has a central processing unit (CPU) circuit unit 206. The CPU circuit unit 206 includes a CPU (not shown), a read only memory (ROM) 207, and a random access memory (RAM) 208. Further, a document feeder (DF) control unit 202, an operation unit 209, an image reader control unit 203, an image signal control unit 204, a printer control unit 205, and a stacker control unit 210 are controlled overall according to a control program stored in the ROM 207. The RAM 208 temporarily stores control data and also provides a working area for calculation processing required for the control.

The DF control unit 202 performs control to drive the document feeding apparatus 950 based on an instruction from the CPU circuit unit 206. The image reader control unit 203 performs control to drive the scanner unit 955 and the image sensor 954 arranged on the image scanning apparatus 951, and transfers an analog image signal output from the image sensor 954 to the image signal control unit 204.

The image signal control unit 204 converts an analog image signal sent from the image sensor 954 to a digital signal, processes the digital signal, converts the processed digital signal to a video signal, and outputs the video signal to the printer control unit 205.

The image signal control unit 204 also performs various types of processing to the digital signal input from a computer 200 or from an external apparatus through an external I/F 201, and converts the digital image signal to a video signal which is then output to the printer control unit 205. The CPU circuit unit 206 controls the processing operation performed by the image signal control unit 204.

The printer control unit 205 drives the exposure apparatus 908 through an exposure control unit (not shown) based on the input video signal. The operation unit 209 includes a plurality of keys configured to set various types of functions for forming an image, and a display unit for displaying a setting state. Further, the operation unit 209 outputs key signals corresponding to each key operation to the CPU circuit unit 206 and also displays information corresponding to signals sent from the CPU circuit unit 206.

The stacker control unit 210 is mounted on the stacker 100 and performs control to drive the entire stacker by exchanging information with the CPU circuit unit 206. The control of the stacker control unit 210 will be described later. The stacker control unit 210 can also be integrated in the CPU circuit unit 206 of the image forming apparatus 901 so that the stacker 100 can be directly controlled from the image forming apparatus main body 901.

Figure 3:
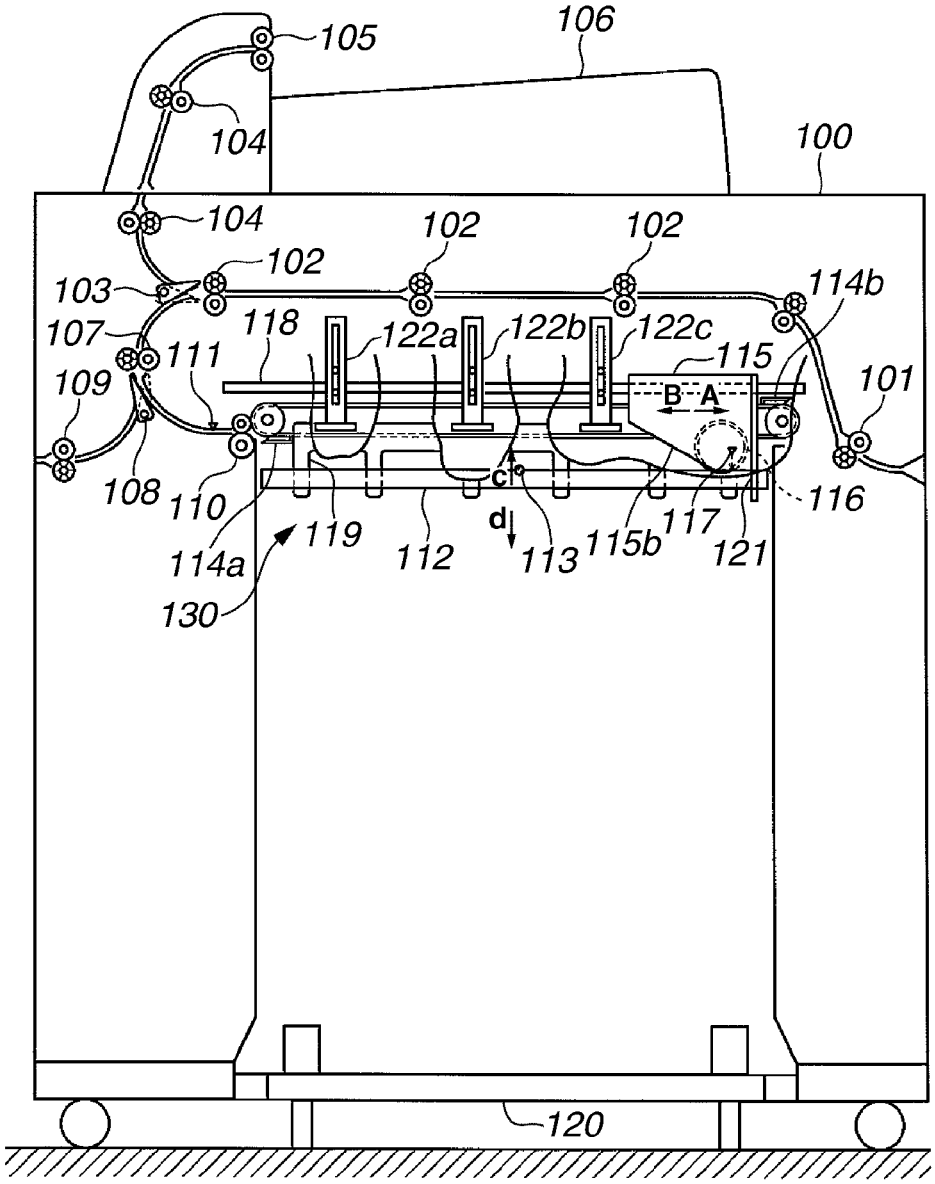
FIG. 3 illustrates a configuration of a stacker connected to a main body of the image forming apparatus.

FIG. 3 illustrates a configuration of the stacker 100. The stacker 100 has a top tray 106 configured to stack sheets discharged from the image forming apparatus main body 901 on its top face. Further, the stacker 100 has a stacking portion 130 including a stacker tray 112, which is a sheet stacking portion configured to stack sheets, and also a switching flapper 103 configured to guide the sheet S conveyed to the stacker 100 to the top tray 106 or to the stacking portion 130.

Furthermore, a solenoid (not shown) drives an outlet switching flapper 108 illustrated in FIG. 3 so that the flapper 108 moves to a position shown by a broken line when the destination of the sheet is a sheet processing apparatus at a downstream side (not shown).

Figure 4:
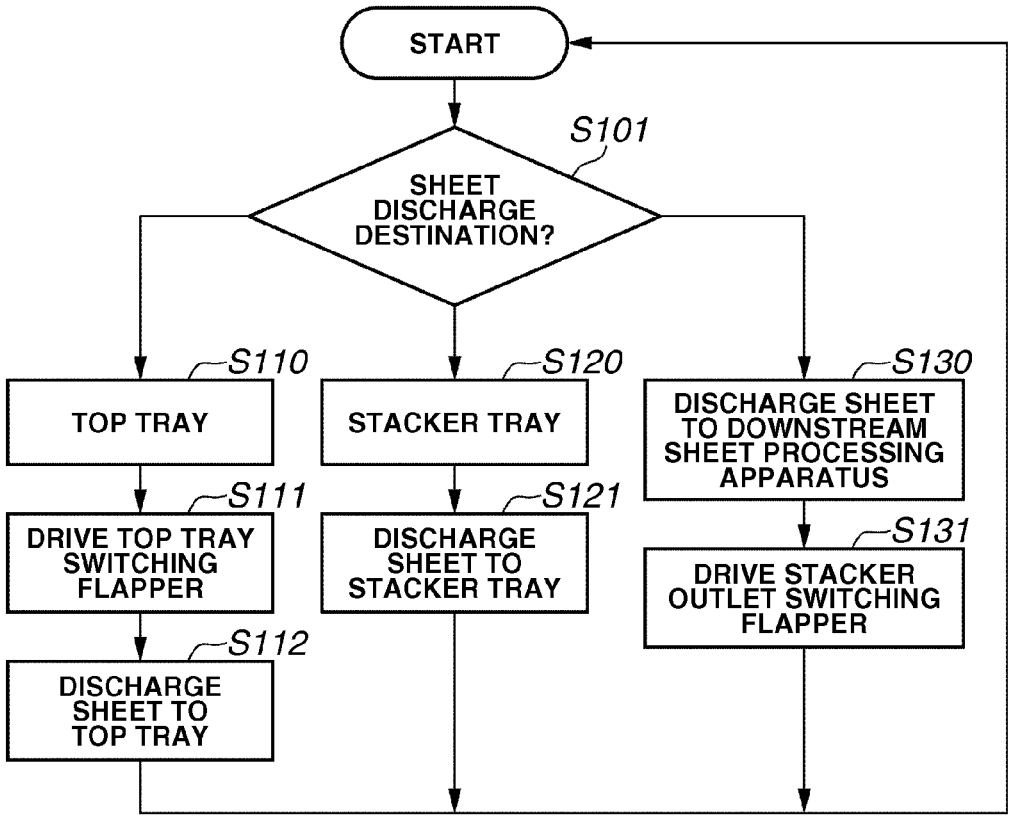
FIG. 4 is a flowchart illustrating basic control of the stacker.

Next, a basic control of the stacker 100 performed by the stacker control unit 210 will be described referring to the flowchart illustrated in FIG. 4.

The sheet S discharged from the image forming apparatus main body 901 is conveyed into the stacker 100 by an inlet roller pair 101 and then conveyed to the switching flapper 103 by conveyance roller pairs 102.

Before the sheet is conveyed, the CPU circuit unit 206 of the control unit 960 in the image forming apparatus main body 901 sends in advance sheet information including sheet size, sheet type, and destination of the sheet to the stacker control unit 210.

The stacker control unit 210 determines a destination of the sheet transferred from the control unit 960 (step S101) If the destination of the sheet is the top tray 106 (step S110), the stacker control unit 210 controls the switching flapper 103 driven by a solenoid (not shown) (step S111) so that the flapper 103 changes its position to a position shown in a broken line in FIG. 3. Thus, the sheet S is guided to conveyance roller pairs 104 and discharged onto the top tray 106 by a top tray discharge roller 105 (step S112) and stacked.

If the destination of the sheet is the stacker tray 112 (stack portion 130) (step S120), the sheet conveyed by the conveyance roller pair 102 is discharged to the stacker tray 112 by a conveyance roller pair 107 and a discharge roller 110 constituting the sheet discharging portion (step S121), and stacked.

If the destination of the sheet is a sheet processing apparatus at a downstream side (step S130), a solenoid (not shown) drives the outlet switching flapper 108 (step S131) so that the flapper 108 changes its position to a position shown in a broken line in FIG. 3. Thus, the sheet conveyed by the conveyance roller pair 102 is conveyed by the conveyance roller pair 107, led to a delivery roller pair 109, and conveyed to the downstream sheet processing apparatus.

As shown in FIG. 3, the stacker tray 112 of the stack portion 130 is arranged so that it can independently move up and down in the directions shown in arrows C and D by a driving device (not shown).

In FIG. 3, a shifting unit 115 shifts a sheet into a downstream side in a sheet discharging direction. The shifting unit 115 includes a knurled belt 116, which is rotated counterclockwise by a driving device (not shown) to shift a discharged sheet into the downstream side of the stacker tray 112 in the sheet discharging direction. Further, the shifting unit 115 includes a taper portion 115*b* configured to guide the sheet to the knurled belt 116. The shifting unit 115 also includes a leading edge stopper 121 (i.e., abutting portion) configured to position a leading edge of the sheet at a predetermined position.

The sheet is drawn by the knurled belt 116 until the sheet edge on a downstream side in a sheet discharging direction abuts against the leading edge stopper 121. The shifting unit 115 is mounted on a slide shaft 118 and is movable along the slide shaft 118 in directions shown in arrows A and B. Also, the shifting unit 115 can be moved to a position corresponding to the sheet size (i.e., sheet length in the sheet discharging direction) by a driving device (not shown).

A sheet surface detection sensor 117 is a sensor configured to keep a constant distance between the shifting unit 115 and the top sheet. It is to be noted that the top sheet in the stacker tray 112 is not only detected by the sheet surface detection sensor 117 but also by a sheet surface detection sensor 113 in the stacking portion 130, which is illustrated in FIG. 5 (i.e., an enlarged view of the stacking portion 130).

The sheet surface detection sensor 113 detects a home position of the stacker tray 112 at an initial operation but functions as a sheet surface detection sensor for the stacker tray 112 during a stacking operation. In FIG. 5, the stacker tray 112 is at a home position for stacking sheets according to detection of the sheet surface detection sensor 113.

Figure 5:
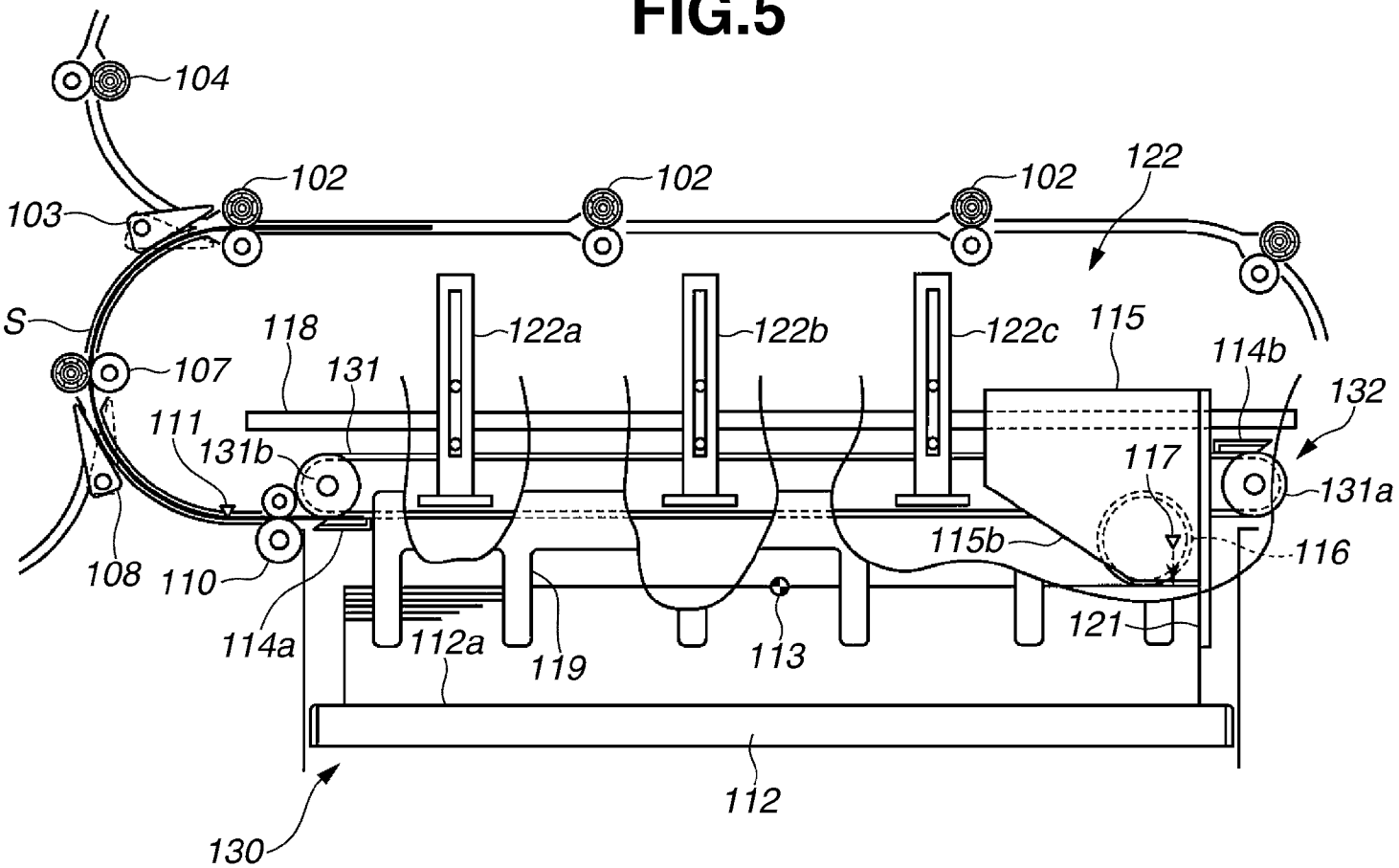
FIG. 5 illustrates an enlarged view of a stacking portion of the stacker.

In FIG. 5, a drive belt 131 is wound around a drive roller 131*a* and a driven roller 131*b* and rotated counterclockwise by a driving device (not shown). Grippers 114*a* and 114*b* are attached to the drive belt 131 and convey a sheet by pinching (holding) a trailing edge of the sheet. The grippers 114*a* and 114*b* and the drive belt 131 constitute the sheet discharging portion 132. The sheet discharging portion 132, which is arranged separate from the stacker tray 112, conveys a sheet along the stacker tray 112, and discharges the sheet onto the stacker tray 112.

The grippers 114*a* and 114*b* are attached to the drive belt 131 and urged in a clockwise direction by a torsion coil spring (not shown). A driving device (not shown) drives the grippers 114*a* and 114*b* so that the grippers 114*a* and 114*b* move to a position where they hold a sheet, and to a position where they release the sheet.

Further, a pressing portion 122 is located above the stacker tray 112. The pressing portion 122 includes a plurality of pressing members 122*a* through 122*c* which move up and down to press the discharged sheet down on the stacker tray 112. In FIG. 5, a timing sensor 111 is arranged upstream of the discharge roller 110. The timing sensor 111 is configured to detect a timing at which the leading edge of a sheet passes. An alignment plate 119 (alignment member) is adapted to align the sheet at an end portion in a direction perpendicular to the sheet discharging direction.

At the stacking portion 130 having such a configuration, when a sheet S is conveyed from the image forming apparatus main body 901 to the discharge roller 110 in the above-described sheet conveying control operation, the timing sensor 111 detects a leading edge of the sheet. Based on the detected timing of the sheet edge passing, either of the grippers 114*a* and 114*b*, which are waiting, for example, the gripper 114*a*, is driven by a driving device (not shown) and pinches (holds) the leading edge of the sheet.

Subsequently, the drive belt 131 rotates counterclockwise, and the gripper 114*a* moves together with the drive belt 131 while holding the leading edge of the sheet. In this way, the sheet is conveyed above and along the stacker tray 112.

Figure 6:
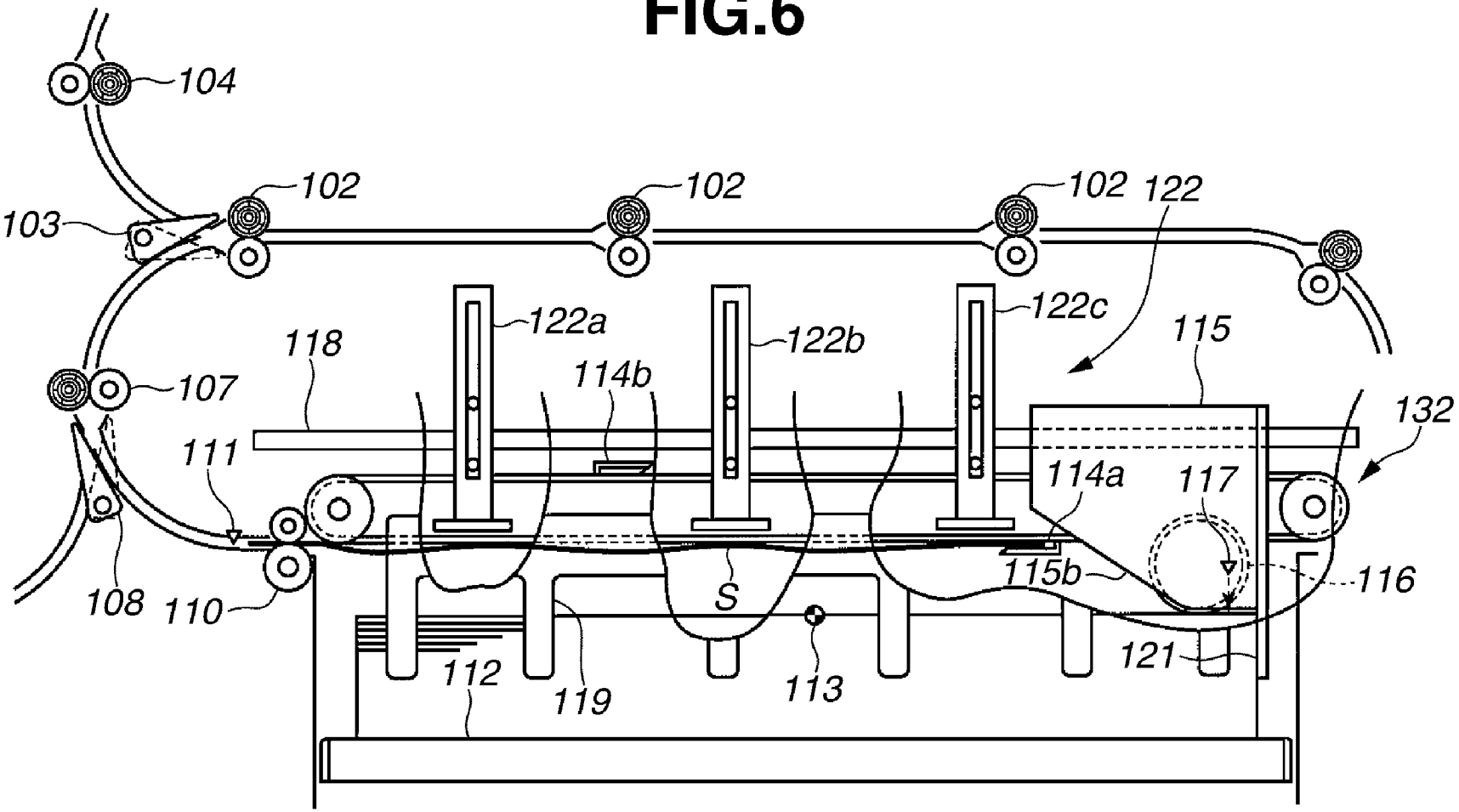
FIG. 6 is an enlarged view of the stacking portion of the stacker illustrating a sheet stacking operation.

Then, when the gripper 114*a* passes a taper portion 115*b* formed on a gripper side of the shifting unit 115 as shown in FIG. 6, the gripper 114*a* is driven to release the sheet. In this way, the sheet S is conveyed while its leading edge is guided by the taper portion 115*b* toward the stacker tray 112 and conveyed to the knurled belt 116.

Figure 7:
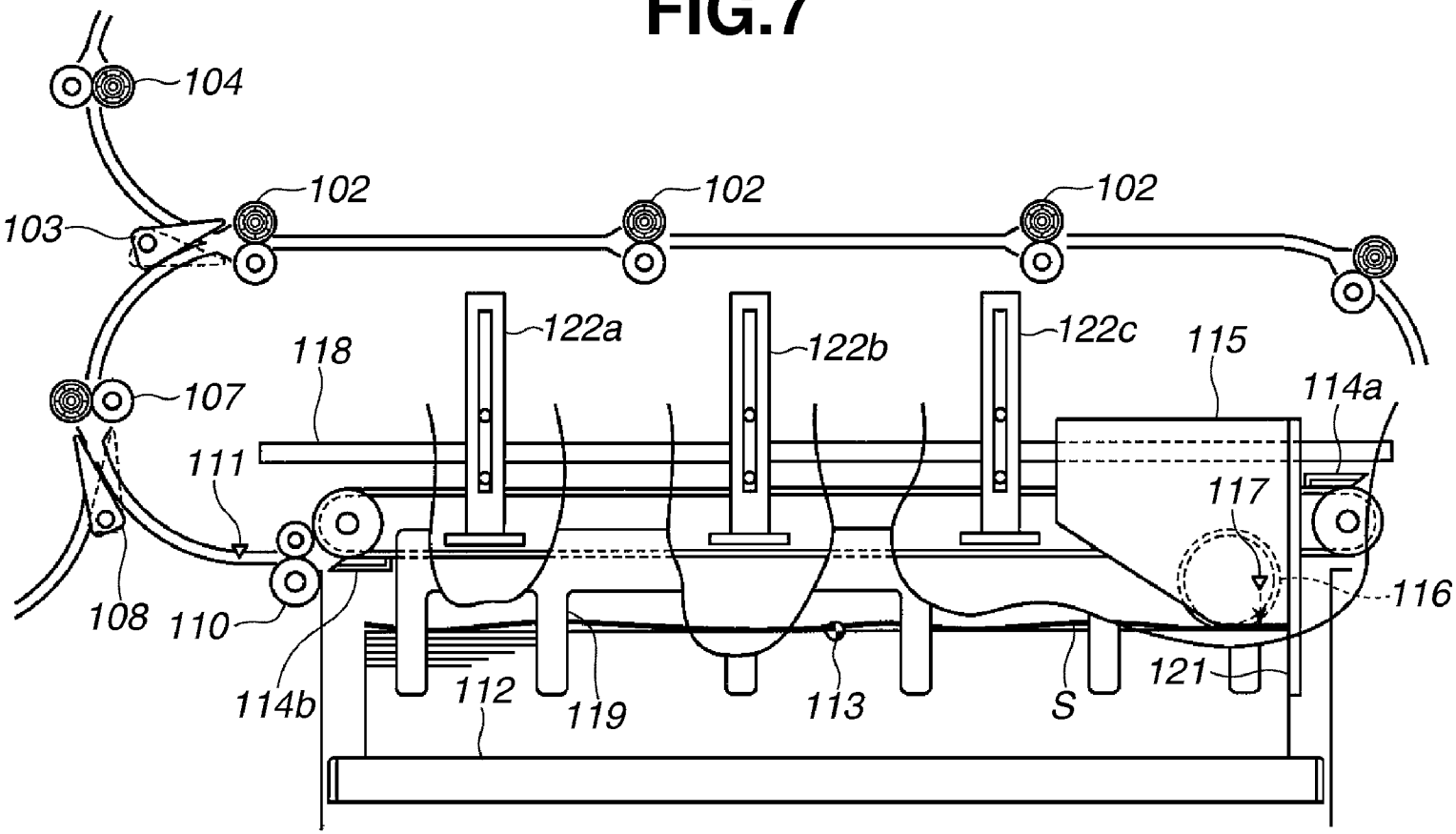
FIG. 7 is an enlarged view of the stacking portion of the stacker illustrating the sheet stacking operation.

At this time, the sheet contacts the knurled belt 116 by a inertia force generated at the time the sheet is conveyed. The sheet S is conveyed by the knurled belt 116 until its leading edge abuts against the stopper 121 as shown in FIG. 7. Then the sheet S is stacked on the stacker tray 112 while the sheet edge on the downstream side in the sheet discharging direction is aligned.

In this state, the knurled belt 116 continues rotating in a direction that shifts the sheet S. According to this rotation, a force is applied to the sheet S that continuously presses the sheet S against the stopper 121. Although the knurled belt 116 continues a shifting operation, the knurled belt 116 is configured so that the sheet S slips over the knurled belt 116 in a state that its leading edge abuts against the stopper 121. With this configuration, undue pressure is not applied to the sheet S. Consequently, the sheet S is not curled by the knurled belt 116 although the knurled belt 116 is operating.

Figure 8:
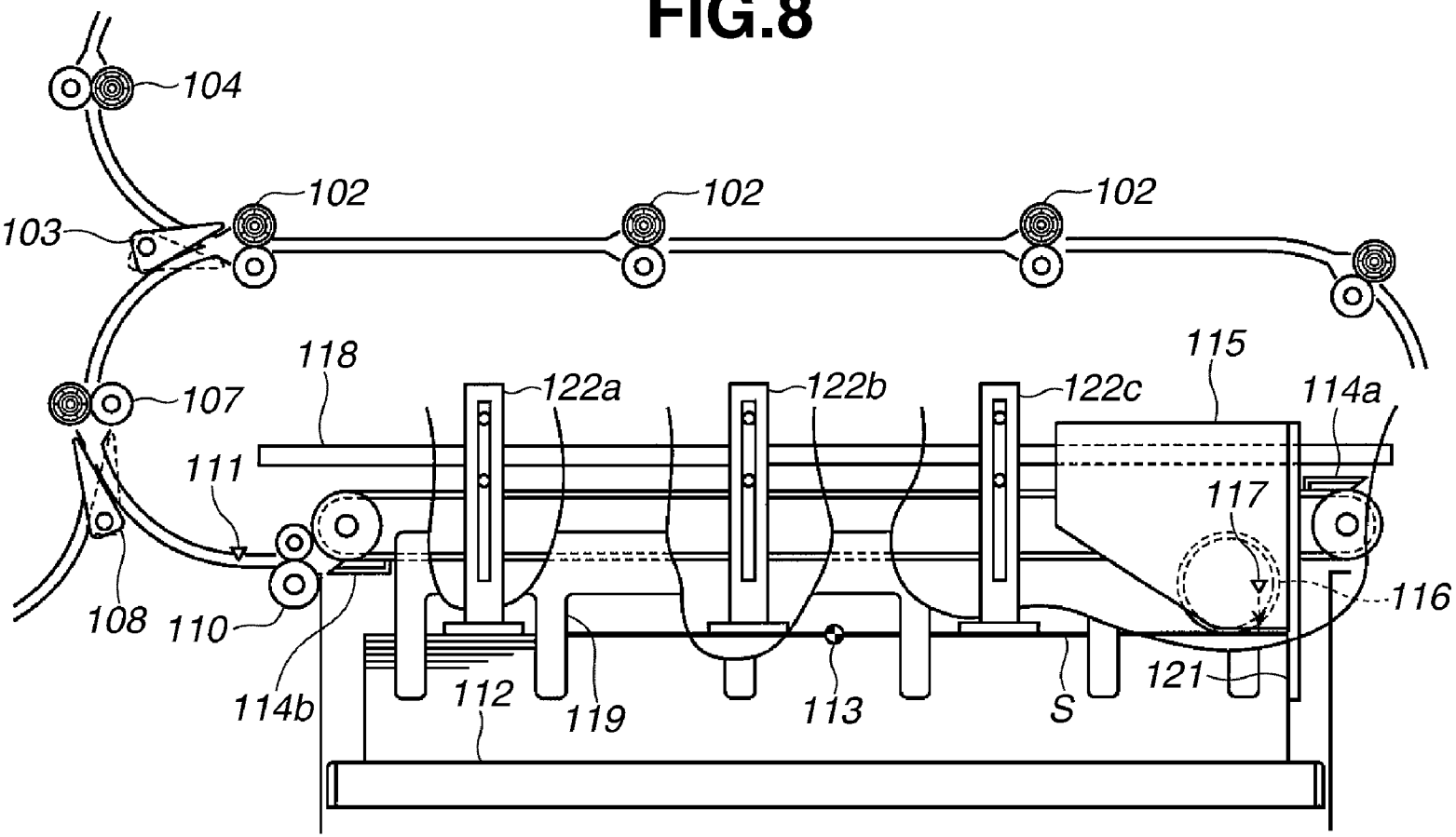
FIG. 8 is an enlarged view of the stacking portion of the stacker illustrating the sheet stacking operation.

Next, as shown in FIG. 8, in this state, the pressing members 122*a* through 122*c* are simultaneously moved for a time down substantially vertically toward a sheet stacking face 112*a* of the stacker tray 112 by a driving device such as a solenoid and press the sheet S to the stacked sheets. In this way, air between the sheet S and the stacked sheets in the entire stacking area is removed, the sheet S can be stacked at high speed with improved stability, and the sheets in the stacker tray 112 is stacked in good condition. Also, a curl of the sheet S can be reduced. This contributes to improving of stackability.

It is to be noted that when the pressing members 122*a* through 122*c* press the sheet S for a time, or when the pressing members 122*a* through 122*c* stop pressing the sheet S, due to an impact, the sheet S can move in a direction parting from the stopper 121. Even in such a case, however, since the knurled belt 116 is rotating, the sheet S is kept in place owing to the rotation force, and a good stacking state is maintained. It is not limited a leading edge in the sheet discharging direction which abuts against an abutting portion. It is possible to keep a sheet at the predetermined position by abutting any sheet edge.

Even when the impact is so great that the alignment state is disturbed, the sheet S immediately returns to the original position of alignment. The rotary force (shifting force) of the knurled belt 116 is adjusted so that the sheet S is not deformed when it is held at the predetermined position.

After that, the pressing members 122*a* through 122*c*, driven by a driving device, move upward and return to their home positions. Then, a lateral end of the stack of sheets in the width direction, which is a direction perpendicular to the sheet discharging direction, is aligned by the alignment plate 119. The alignment plate 119 retracts in by a predetermined amount after it aligns the stack of sheets and waits until a new sheet is conveyed. Thus, the alignment in the width direction prevents a leading edge of a next sheet from colliding against the trailing edge of the preceding sheet when the next sheet is discharged onto the stacker tray 112.

The stacker control unit 210 continuously monitors the top sheet in the stacker tray 112 through the sheet surface detection sensors 117 and 113. If a distance between the shifting unit 115 and the top sheet becomes smaller than a predetermined distance, a stacker tray driving device (not shown) moves down the stacker tray 112 for a predetermined distance so that the distance between the shifting unit 115 and the top sheet remains constant. By repeating this operation, the sheets are stacked on the stacker tray 112 one after another.

Then, a detection device (not shown) configured to detect a number of sheets discharged from the discharge roller 110 or to detect a height of the sheets stacked on the stacker tray 112, detects that the stacker tray 112 is fully loaded.

Even when the stacker tray 112 is detected as fully loaded by counting a number of discharged sheets, the height of the stacked sheets is reduced by removing air between the sheet S and the stacked sheets or by correcting a curl of the sheets, which prevents the next sheet from colliding with the sheets already stacked. Alternatively, the stacker tray 112 is moved upward until the top sheet, whose height is lowered by removing the air or by correcting the curl, is detected by the detection device. In this way, a number of sheets that can be stacked on a tray is prevented from decreasing.

When the stacker tray 112 is fully loaded, the stacker control unit 210 controls the stacker tray 112 to move down and fixes the stacker tray 112 on a dolly 120. Then, an operator removes the stack of image-formed sheets from the stacker 100.

If the operator sets the dolly 120 and the stacker tray 112 in the stacker 100 after removing the sheets on the stacker tray 112, the stacker tray 112 moves upward and returns to the position shown in FIG. 3 to receive the next sheet.

The shifting unit 115 continues a shifting operation in a state that a leading edge of a sheet abuts against the stopper 121, and the pressing members 122*a* through 122*c* press the sheet to the sheet stacking face 112*a* while the sheet abuts against the stopper 121. Thus, sheets can be stacked at a high speed with stability and a high degree of accuracy by the shifting unit 115.

According to the present exemplary embodiment, the sheet S is thrust against the stopper 121 by the knurled belt 116, pressed by the pressing members 122*a* through 122*c*, and aligned by the alignment plate 119. The present invention, however, is not limited to such a sequence. For example, the sheet S can be thrust against the stopper 121 by the knurled belt 116, aligned by the alignment plate 119 in a width direction, which is perpendicular to a sheet discharging direction, and then pressed by the pressing members 122*a* through 122*c*. Even in this order, a similar effect can be achieved.

Further, a similar effect can also be achieved by pressing the sheet S with the pressing members 122*a* through 122*c* for a time while the sheet is drawn to the stopper 121 by the knurled belt 116.

Figure 9:
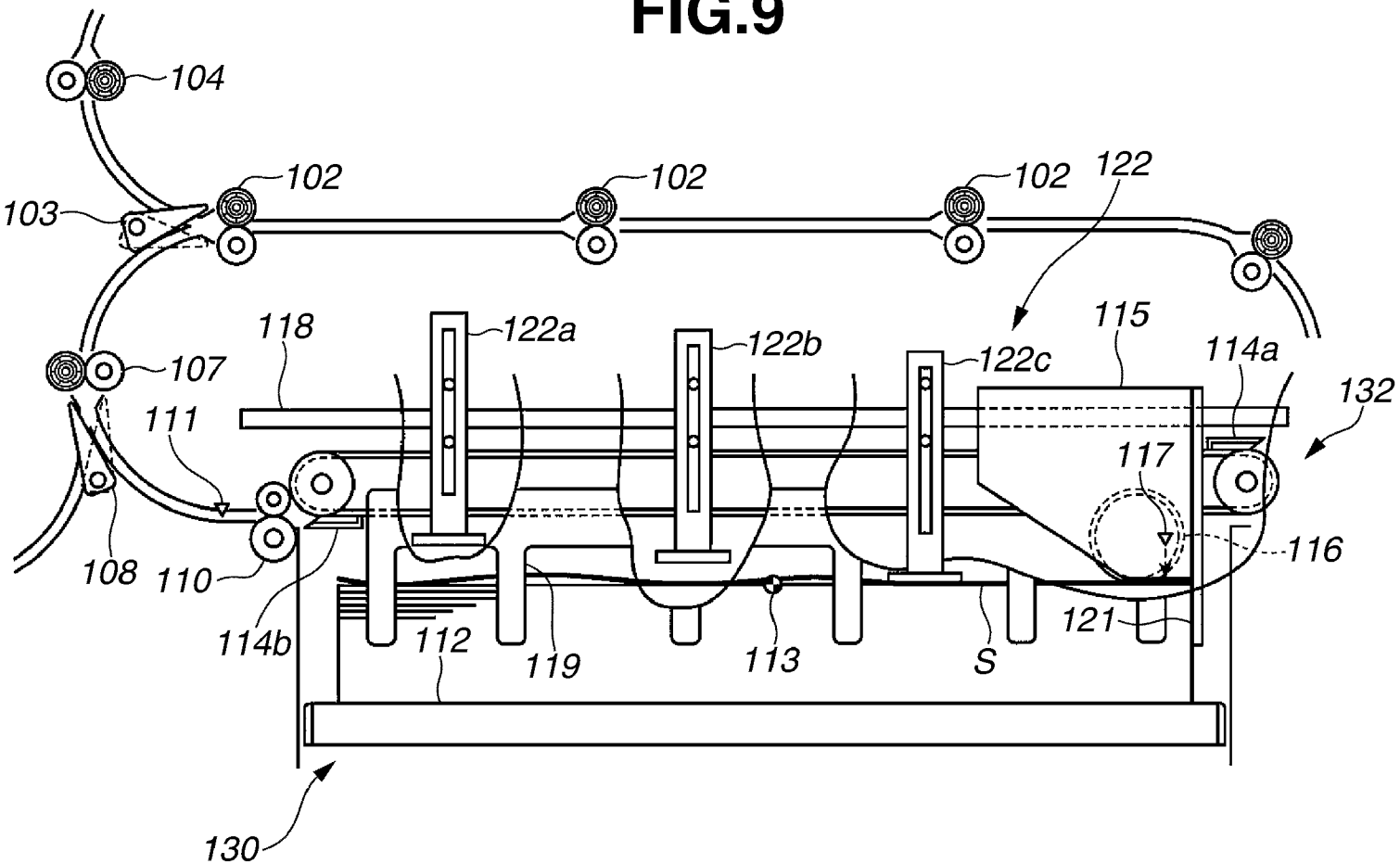
FIG. 9 is an enlarged view of the stacking portion of the stacker illustrating another configuration of the stacker.
Figure 10:
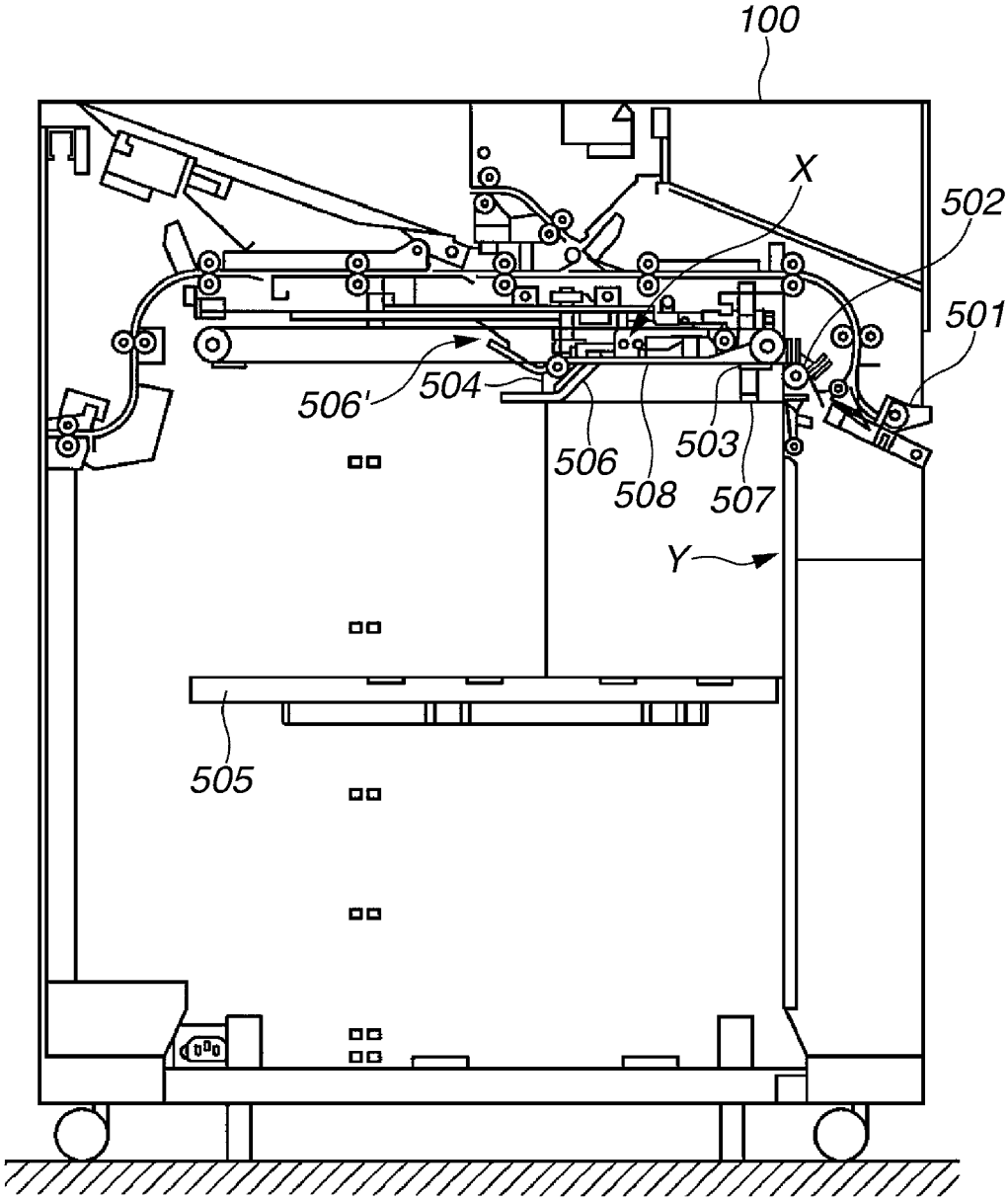
FIG.10 PRIOR ART
FIG. 10 illustrates a configuration of a conventional high-volume sheet stacking apparatus.

Furthermore, after the leading edge of the sheet S abuts against the stopper 121, the pressing members 122*a* through 122*c* can be successively moved down to the stacker tray side starting from the pressing member 122*c* on the stopper side as shown in FIG. 9. In other words, a driving device such as a solenoid (not shown) can cause the pressing members 122*a* through 122*c* to move down in an order of the pressing member 122*c*, the pressing member 122*b*, and the pressing member 122*a* with a delayed timing and to press the sheet S to the stacked sheets. This is because if a plurality of pressing members 122*a* through 122*c* press the sheet at a time, it can become difficult to remove the air between the sheet S and the stacked sheets since the space for the air to pass is narrowed and the air can not easily escape.

If the pressing members 122*a* through 122*c* press the sheet S with a delayed timing, the air between the sheet S and the stacked sheets can be successively discharged from a stopper side to an opposite end while an alignment of the sheet S is maintained. Therefore, the sheets on the stacker tray 112*a* will be stacked in good condition. After that, the pressing members 122*a* through 122*c* retract upward to their home positions, and alignment of the sheet edge in a width direction, which is perpendicular to the sheet charging direction, will be performed by the alignment plate 119. Accordingly, the next sheet can be discharged onto the stacker tray 112 while its leading edge does not collide with the trailing edge of the preceding sheet.

Although the exemplary embodiment of the present invention uses the grippers 114*a* and 114*b* in the sheet discharging portion 132 as a device configured to convey the sheet, the present invention is not limited to such a device. For example, an air attracting unit (by suction) or an electrostatic attracting unit can also be used to obtain a similar effect so long as a sheet is conveyed and discharged by holding the leading edge of the sheet.

While the above exemplary embodiment has been described referring to a case where one stacker tray 112 is used, the present invention is not limited to such a case. For example, a similar effect can be achieved by a plurality of stacker trays arranged side-by-side in a sheet discharging direction and each stacker tray includes a shifting unit and a pressing member of the above-described configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application Nos. 2006-242077 filed Sep. 6, 2006 and 2007-214887 filed Aug. 21, 2007, which are hereby incorporated by reference herein in their entirety.

What is claimed is:

1. A sheet stacking apparatus comprising:

a sheet discharging portion configured to discharge a sheet;

a sheet stacking portion on which the sheet discharged from the sheet discharging portion is stacked;

an abutting portion against which a sheet edge abuts, and configured to position the sheet stacked on the sheet stacking portion at a predetermined position;

a shifting unit configured to shift the sheet discharged on the sheet stacking portion to the abutting portion; and a plurality of pressing members arranged in a shifting direction and upstream of the shifting unit in the shifting direction of the shifting unit, configured to move down to press the sheet stacked on the sheet stacking portion from a retracted position where the pressing member is separated from the sheet stacked on the sheet stacking portion; and a controller to control the sheet stacking apparatus, where the sheet is sequentially pressed by the plurality of pressing members from a near side of the abutting portion to an opposite side, wherein after the sheet edge abuts against the abutting portion by a shifting operation of the shifting unit, the sheet is pressed towards a sheet stacking face of the sheet stacking portion by downward movement of the pressing member from the retracted position while the shifting unit applies a continuous force to keep the sheet edge at the abutting portion.

2. The sheet stacking apparatus according to claim 1, wherein the pressing member presses the sheet toward the sheet stacking face of the sheet stacking portion in a substantially vertical direction.

3. The sheet stacking apparatus according to claim 1, wherein the shifting unit is configured to slip over the sheet in a state that the sheet edge abuts against the abutting portion.

4. The sheet stacking apparatus according to claim 1, further comprising an alignment member configured to align an end of the sheet in a direction perpendicular to a shifting direction of the shifting unit.

5. The sheet stacking apparatus according to claim 1, wherein the sheet discharging portion includes a gripper.

6. The sheet stacking apparatus according to claim 1, wherein the sheet discharging portion includes an air attracting unit.

7. The sheet stacking apparatus according to claim 1, wherein the sheet discharging portion includes an electrostatic attracting unit.

8. An image forming apparatus comprising an image forming portion configured to form an image on a sheet and the sheet stacking apparatus configured to stack image-formed sheets according to claim 1.

9. The sheet stacking apparatus according to claim 1, wherein when the sheets are discharged by the sheet discharging portion continuously, every time the sheet edge of the discharged sheet abuts against the abutting portion, the pressing member moves downwardly to press each discharged sheet.

* * * * *